US006397725B1

(12) United States Patent
Guy

(10) Patent No.: US 6,397,725 B1
(45) Date of Patent: Jun. 4, 2002

(54) PISTON AND CYLINDER ASSEMBLY AND FLOW RESTRICTOR DEVICE THEREFOR

(75) Inventor: Mark Anthony Guy, Codsall (GB)

(73) Assignee: Lucas Industries Limited, London (GB)

( * ) Notice: Subject to any disclaimer, the term of this patent is extended or adjusted under 35 U.S.C. 154(b) by 0 days.

(21) Appl. No.: 09/564,109

(22) Filed: May 3, 2000

(30) Foreign Application Priority Data

May 5, 1999 (GB) ..... 9910257

(51) Int. Cl.[7] ..... F15B 15/22
(52) U.S. Cl. ..... 91/394; 91/409
(58) Field of Search ..... 91/394, 405, 407, 91/392, 408, 409, 396

(56) References Cited

U.S. PATENT DOCUMENTS 2,935,047 A * 5/1960 Ortman et al. ..... 91/396
4,424,737 A * 1/1984 Endo ..... 91/396
4,425,836 A * 1/1984 Picrell ..... 91/405
5,517,898 A * 5/1996 Kim ..... 91/407
6,047,627 A * 4/2000 Bueter ..... 91/396

* cited by examiner

*Primary Examiner*—Edward K. Look
*Assistant Examiner*—Igor Kershteyn
(74) *Attorney, Agent, or Firm*—Wells, St. John et al.

(57) ABSTRACT

A piston and cylinder assembly is described having a piston which partially defines a fluid chamber in the cylinder from which fluid is expelled through an outlet port of the cylinder by movement of the piston along the cylinder, the assembly including a flow restrictor providing a first restricted flow path between the chamber and port, and also providing an auxiliary restricted flow path of which a first portion communicates with the chamber and of which a second portion extends between the first portion and the port.

18 Claims, 3 Drawing Sheets

PISTON AND CYLINDER ASSEMBLY AND FLOW RESTRICTOR DEVICE THEREFOR

This invention relates to a piston and cylinder assembly, wherein the piston partially defines a fluid chamber in the cylinder from which fluid is expelled through an outlet port of the cylinder by movement of the piston along the cylinder. The invention also includes a flow restrictor device for use in such a piston and cylinder arrangement.

It is known in such an assembly to provide a flow restrictor device in the form of a snubbing ring carried by the piston and having an axially extending groove in its outer peripheral surface communicating with the port. As the piston moves past the port during operation of the assembly, the ring partially seals the port and the ring groove provides restricted communication between the chamber and port, permitting the piston to be decelerated in a controlled manner towards the end of its operative stroke.

The invention provides a piston and cylinder assembly, wherein the piston partially defines a fluid chamber in the cylinder from which fluid is expelled through an outlet port of the cylinder by movement of the piston along the cylinder, the assembly including flow restrictor means providing a first restricted flow path between the chamber and port, said means also providing an auxiliary restricted flow path of which a first portion communicates with the chamber and of which a second portion extends between the first portion and the port.

Such an arrangement provides alternative controlled release routes for fluid from the chamber through the port, ensuring continued controlled deceleration of the piston in the event that a blockage occurs in one of the flow paths.

Preferably, the first portion of the auxiliary flow path is circumferentially spaced from the first flow path and conveniently extends axially, the second portion of the auxiliary flow path conveniently extending circumferentially.

In one convenient arrangement, the second portion of the auxiliary flow path includes a portion of the first restricted flow path spaced from the chamber axially along the cylinder.

The flow paths may be passageways formed in the piston and are conveniently of uniform cross-sectional dimension. The passageways are, typically, in the form of grooves in the outer periphery of the piston.

Alternatively, the passageways may be formed in a ring carried by the piston or cylinder, the flow paths then conveniently being grooves formed in the ring.

The invention also includes a restrictor device in the form of a ring for mounting in a piston and cylinder assembly, the ring having a plurality of axially extending passageways interconnected by a further passageway, which may conveniently extend circumferentially, for providing alternative restricted routes for releasing fluid into a port from a chamber partially defined by the piston.

Conveniently, the ring is mountable on the piston, the channels typically being formed by grooves in the outer periphery of the ring.

In order that the invention may be well understood, an embodiment thereof, which is given by way of example only, will now be described with reference to the accompanying drawings, in which.

Figure 1:
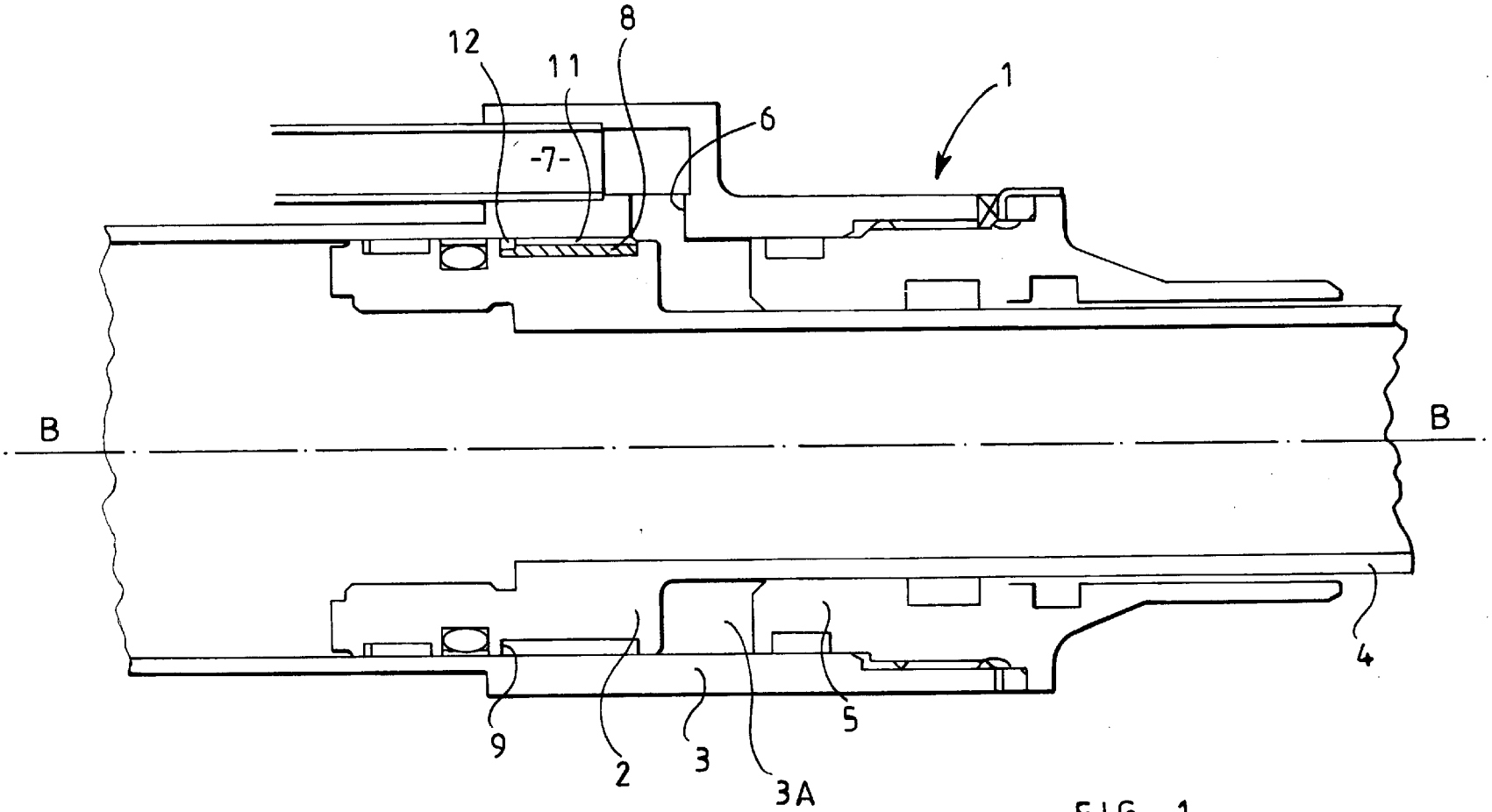
FIG. 1 is a sectional side view of an actuator.
Figure 2:
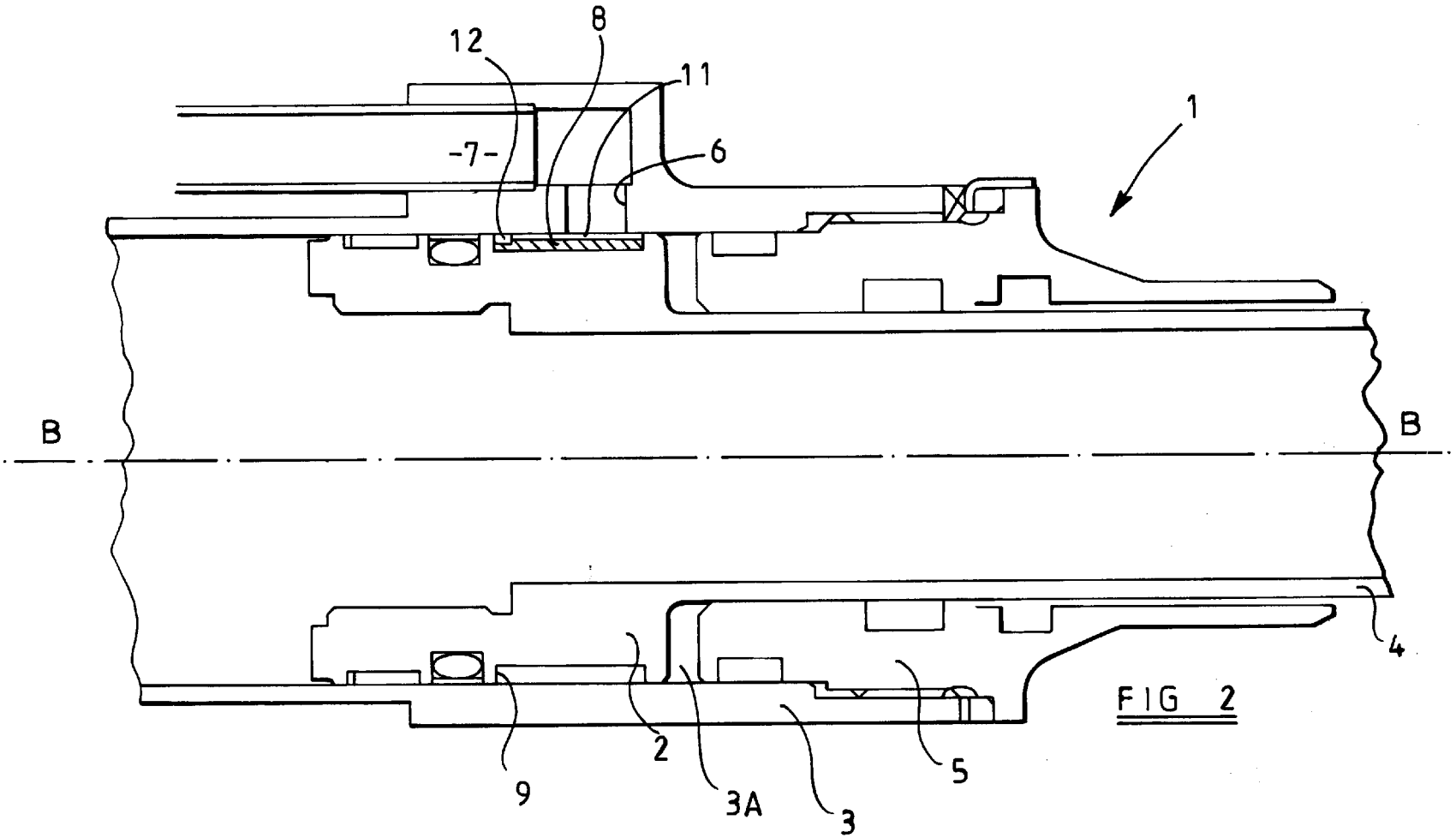
FIG. 2 is another sectional side view of the actuator showing a piston of the actuator in a different operating condition to that shown in FIG. 1.
Figure 3:
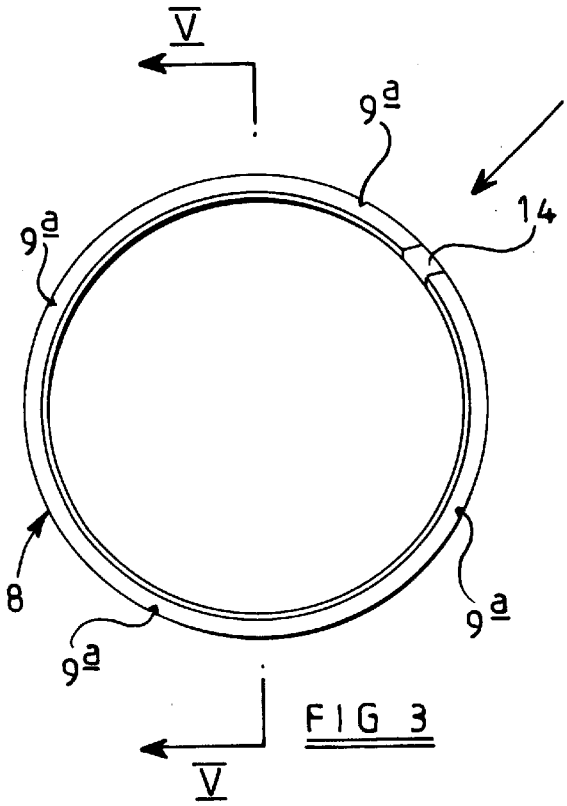
FIG. 3 is an end view of a snubbing ring of the actuator.
Figure 4:
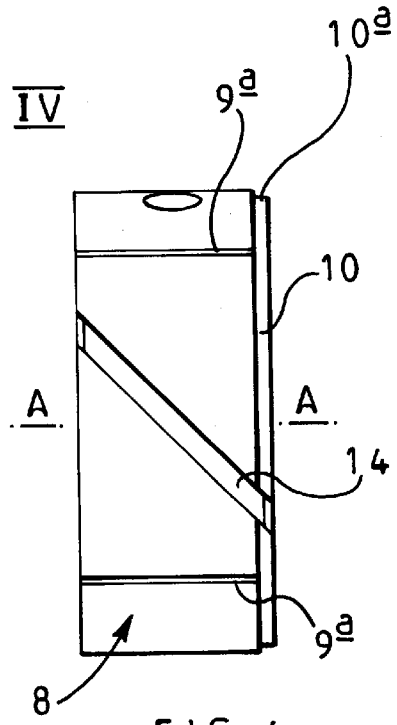
FIG. 4 is a side view of the ring.
Figure 5:
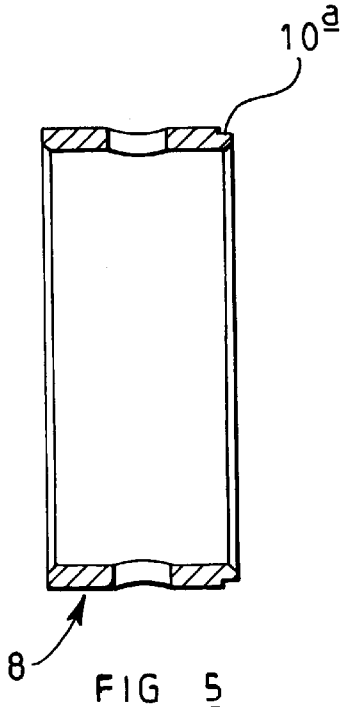
FIG. 5 is a sectional side view of the ring.
Figure 6:
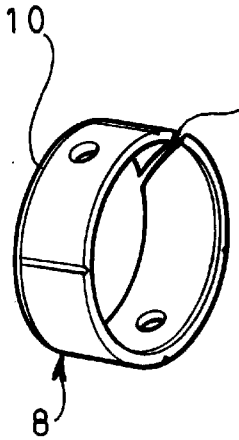
FIG. 6 is a perspective view of the ring.

The actuator 1 shown in FIGS. 1 and 2 has a piston 2 axially movable within a cylinder 3 of the actuator. The piston is connected to a piston rod 4, which extends through a gland 5 to the exterior of the actuator, a chamber 3A being defined between opposing faces of the piston and gland. A port 6 in the cylinder's peripheral wall leads via a connector 7 to a desired location. The piston 2 in this embodiment carries a flow restrictor device in the form of a snubbing ring 8 disposed in a circumferentially extending recess 9 in the piston. Details of the ring 8 are omitted from the lower half of FIGS. 1 and 2 for convenience.

FIGS. 3 to 6 show the ring 8 in greater detail. The ring 8 has four mutually parallel grooves 9*a* in its outer peripheral surface, which extend along the direction of a longitudinal axis A—A of the ring 8 and are circumferentially spaced about the ring 8. It should be understood that, instead of the four grooves 9*a,* a different number of grooves may be provided, for example two grooves or six grooves 9*a*. The ring 8 is fitted in the actuator 1 so that the axis A—A lies along a longitudinal axis B—B of the actuator 1. The ring has an end portion 10 of reduced outer diameter at its right hand end in the orientation shown in FIGS. 4 and 5, formed by a circumferentially extending groove in the form of a step 10*a* in the peripheral surface of the ring 8. With the ring 8 fitted in the actuator 1, the grooves 9*a* in conjunction with the cylinder form axially extending passageways 11, and the step 10*a* in conjunction with the cylinder and a wall of the recess 9 forms a circumferential passageway 12 that places the passageways 11 in communication with one another.

In use, when the piston is driven towards its hardstop position against the gland 5, it is desirable to quickly reduce its speed to cushion its impact on the gland 5. In the position shown in FIG. 1, fluid in the chamber 3A of the cylinder 3 is forced out of the open port 6, preventing a significant build up of pressure in the cylinder 3.

However, when the piston 2 has moved past the port 6, as shown in FIG. 2, the port is restricted by the ring 8. The chamber 3A is closed and contains a volume of fluid, which is progressively released. The circumferentially outer periphery of the leading end of the piston does not seal against the cylinder and does not present a significant restriction to flow between the closed chamber 3A and the port 6. The rate at which the fluid is released from the chamber 3A to the port 6 determines the deceleration of the piston and is dictated by the ring 8, the outer periphery of which does seal against the cylinder. The desired cushioning of the piston movement can therefore be provided by selecting the sizes of the passageways 11,12 so as to permit a desired restricted flow of fluid from the chamber 3A through the passageways 11,12 to the port 6. A selection of rings 8 arranged to provide different restricted flow rates can be provided for use with a common design of piston body.

It will be appreciated that a blockage may occur in the upper passageway 11 as seen in FIG. 1 so as to prevent fluid flowing to the port 6 along the shortest route direct from the chamber 3A, through the nearest end portion of the passageway. In such an event, the other passageways 11, in combination with the circumferential passageway 12, provide auxiliary restricted flow paths along which fluid can alternatively flow from the chamber 3A to the port 6. In the embodiment described, such auxiliary route includes an end portion of the upper passageway 11 spaced from the chamber 3A axially along the cylinder. It will, however, be understood that the auxiliary flow path may communicate with the port 6 other than via said passageway.

The ring 8 is provided with a scarf cut 14 (FIGS. 3 and 4) for fitting the ring 8 to the body of the piston 2. Whilst seepage of fluid may occur through the scarf cut 14, this is not intended significantly to affect the cushioning effect of the ring.

The grooves 9*a* may be formed directly in the piston 2 or in the internal wall of the cylinder 3 and a separate ring 8 dispensed with.

The passageways may be provided by through holes in the ring, piston or cylinder.

Figure 7:
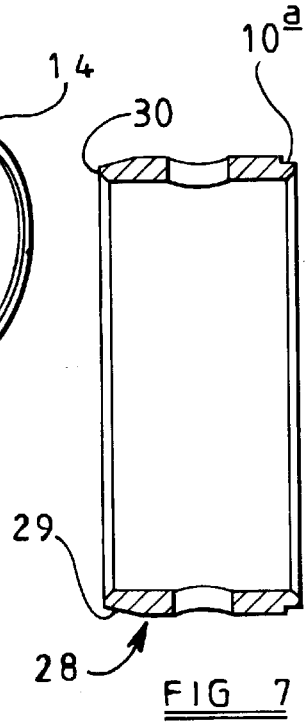
FIG. 7 is an alternative snubbing ring of the actuator.

An alternative snubbing ring 28 is shown in FIG. 7, which is identical with the snubbing ring 8 except that the ring is provided with a chamfer 29 so that the outer peripheral surface of the ring 28 tapers inwardly towards the ring's leading edge 30. The chamfer facilitates a more progressive decelerating effect as the piston nears the end of its stroke. Piston rings with variously configured tapers may be provided to provide a variety of decelerating effects. For example, the angle and/or axial extent of the chamfer 29 can be varied.

What we claim is:

1. A restrictor device for mounting in a piston and cylinder assembly, the device comprising a ring mountable on said piston and having a plurality of axially extending grooves or passageways interconnected by a further groove or passageway, for providing alternative restricted routes for releasing fluid into a port from a chamber partially defined by the piston.

2. A device as claimed in claim 1, wherein a peripheral surface of the ring tapers radially inwardly in a direction towards an axial end of the ring.

3. A piston and cylinder assembly, the cylinder having a wall and the piston having a reciprocating stroke within the cylinder, wherein the piston partially defines a fluid chamber in the cylinder from which fluid is expelled radially through an outlet port, positioned in the cylinder wall within the stroke of the piston, by movement of the piston along the cylinder, the assembly including flow restrictor means comprising:

a plurality of substantially axial restricted flow passages including a first restricted flow passage for providing fluid communication between said chamber, at a first entry point to said first restricted flow passage, and said port, and at least one auxiliary restricted flow passage; and a communicating flow passage coupling said auxiliary flow passage to a second entry point to said first restricted flow passage, thereby providing for an alternative fluid communication passage between said chamber and said port.

4. An assembly as claimed in claim 3, wherein said auxiliary restricted flow passage is circumferentially spaced from said first restricted flow passage.

5. An assembly as claimed in claim 4, wherein said communicating flow passage has a circumferentially extending portion.

6. An assembly as claimed in claim 3, wherein the flow passages are passageways at least partially formed in the piston.

7. An assembly as claimed in claim 6, wherein the passageways are partially formed by grooves in the outer periphery of the piston.

8. An assembly as claimed in claim 3, wherein the flow passages are passageways at least partially formed in a ring carried by the piston or cylinder.

9. An assembly as claimed in claim 8, wherein the passageways are partially formed by grooves in a peripheral surface of the ring.

10. An assembly as claimed in claim 8, wherein a peripheral surface of the ring tapers radially inwardly in a direction towards an axial end of the ring adjacent the chamber.

11. An assembly comprising:

a cylinder having a wall;

a piston configured to have a reciprocating stroke within the cylinder, wherein the piston partially defines a fluid chamber in the cylinder from which fluid is expelled radially through an outlet port positioned in the cylinder wall within the stroke of the piston by movement of the piston along the cylinder;

a flow restrictor comprising:

a plurality of substantially axial restricted flow passages including a first restricted flow passage for providing fluid communication between the fluid chamber, at a first entry point to the first restricted flow passage, and the port, and at least one auxiliary restricted flow passage; and a communicating flow passage coupling the auxiliary flow passage to a second entry point to the first restricted flow passage to provide an alternative fluid communication passage between the fluid chamber and the port.

12. An assembly as claimed in claim 11, wherein said auxiliary restricted flow passage is circumferentially spaced from said first restricted flow passage.

13. An assembly as claimed in claim 12, wherein said communicating flow passage has a circumferentially extending portion.

14. An assembly as claimed in claim 11, wherein said flow passages are passageways at least partially formed in the piston.

15. An assembly as claimed in claim 14, wherein the passageways are partially formed by grooves in the outer periphery of the piston.

16. An assembly as claimed in claim 11, wherein the flow passages are passageways at least partially formed in a ring carried by the piston or cylinder.

17. An assembly as claimed in claim 16, wherein the passageways are partially formed by grooves in a peripheral surface of the ring.

18. An assembly as claimed in claim 16, wherein a peripheral surface of the ring tapers radially inwardly in a direction towards an axial end of the ring adjacent the chamber.

* * * * *